US007774864B2

(12) United States Patent
Carlson

(10) Patent No.: US 7,774,864 B2
(45) Date of Patent: Aug. 17, 2010

(54) VEST AND POCKET FASTENING SYSTEM

(75) Inventor: Richard A. Carlson, Yorba Linda, CA (US)

(73) Assignee: Safari Land Ltd., Inc., Ontario, CA (US)

( * ) Notice: Subject to any disclaimer, the term of this patent is extended or adjusted under 35 U.S.C. 154(b) by 946 days.

(21) Appl. No.: 10/982,412

(22) Filed: Nov. 5, 2004

(65) Prior Publication Data

US 2006/0096009 A1 May 11, 2006

(51) Int. Cl.
*A41D 27/20* (2006.01)

(52) U.S. Cl. ..... 2/249

(58) Field of Classification Search ..... 2/94, 2/102, 69, 247, 249; 24/3.7
See application file for complete search history.

(56) References Cited

U.S. PATENT DOCUMENTS 313,762 A * 3/1885 Pattee ..... 2/249
779,898 A 1/1905 Yates
879,638 A 2/1908 Hayes
1,279,623 A * 9/1918 Weis ..... 2/249
1,310,125 A 7/1919 Lundberg et al.
1,886,718 A 11/1932 Noel
3,515,363 A 6/1970 Fisher
4,815,510 A 3/1989 Edelist
4,821,934 A 4/1989 Alessi et al.
5,031,244 A 7/1991 Inagaki
5,067,643 A * 11/1991 McKinney ..... 224/197
5,085,163 A * 2/1992 VanTassel et al. ..... 405/186
5,109,576 A 5/1992 Teekell et al.
5,312,029 A * 5/1994 Tuber ..... 224/679
5,313,721 A 5/1994 Filden
5,465,425 A 11/1995 Crispin
5,504,976 A 4/1996 Reeves
5,509,147 A 4/1996 Busquets
5,644,794 A 7/1997 Hull et al.
5,724,707 A 3/1998 Kirk et al.
5,813,162 A * 9/1998 Tse et al. ..... 43/21.2
5,839,173 A 11/1998 Otrusina
5,893,370 A 4/1999 Perez et al.
5,991,925 A 11/1999 Wu
6,038,742 A 3/2000 Patterson
6,131,198 A 10/2000 Westrick
6,161,741 A * 12/2000 French ..... 224/198

(Continued)

FOREIGN PATENT DOCUMENTS

CA 2 258 693 C 12/1997

(Continued)

OTHER PUBLICATIONS

Australian Patent Office Search Report for Singapore Patent Application No. 200505633-8 entitled *Vest and Pocket Fastening System*, date of mailing Mar. 30, 2006, 4 pages.

(Continued)

*Primary Examiner*—Tejash Patel
(74) *Attorney, Agent, or Firm*—Christie, Parker & Hale, LLP

(57) ABSTRACT

A pocket fastening system for a vest wherein the pocket has a backing plate and a plurality of fasteners positioned on the backing plate for receipt into recesses formed on horizontal webbing strips on the surface of the vest.

6 Claims, 2 Drawing Sheets

U.S. PATENT DOCUMENTS

| | | | | |
|---|---|---|---|---|
| 6,206,209 | B1 * | 3/2001 | Houg-Brown | 211/85.3 |
| 6,233,747 | B1 | 5/2001 | Barker | |
| 6,298,526 | B1 | 10/2001 | Baumdicker et al. | |
| 6,516,981 | B2 | 2/2003 | Perez et al. | |
| 6,640,343 | B2 | 11/2003 | Peters | |
| 6,662,373 | B2 | 12/2003 | Frank | |
| 6,823,566 | B2 | 11/2004 | Coffey | |
| 7,080,430 | B2 * | 7/2006 | Wemmer | 24/578.13 |
| 7,162,281 | B2 * | 1/2007 | Kim | 455/575.1 |
| 7,266,850 | B1 * | 9/2007 | Strum et al. | 2/2.5 |
| 2003/0106917 | A1 | 6/2003 | Shetler et al. | |
| 2003/0141332 | A1 | 7/2003 | Rivera et al. | |
| 2003/0173390 | A1 | 9/2003 | Smith | |
| 2004/0187183 | A1 | 9/2004 | Hautala | |
| 2005/0144704 | A1 | 7/2005 | Vitallo | |

FOREIGN PATENT DOCUMENTS

| | | | |
|---|---|---|---|
| CA | 2 408 932 | A1 | 12/2001 |
| CA | 2 494 679 | A1 | 2/2004 |
| EP | 1 316 262 | B1 | 6/2003 |
| EP | 1 656 043 | | 5/2006 |
| FR | 2 721 179 | | 12/1995 |
| JP | 11-286816 | | 10/1999 |
| WO | WO 97/48302 | | 12/1997 |
| WO | WO 01/93710 | A1 | 12/2001 |

OTHER PUBLICATIONS

European Search Report for Application No. EP 05 09 0294; date of completion of the search Apr. 16, 2008; place of search Munich (11 pages).

First Office action issued in Japanese Application No. 2005-298674, mailed on Dec. 9, 2008, with English translation.

Second Office action issued in Japanese Application No. 2005-298764, mailed on Oct. 13, 2009, with English translation.

* cited by examiner

VEST AND POCKET FASTENING SYSTEM

BACKGROUND OF THE INVENTION

The present invention relates generally to a fastener for attaching objects to garments, and, more particularly, to a fastening system that securely mounts removable pockets to an outer surface of a vest. It is well recognized that certain types of modular load bearing vests and backpacks with modular pockets employ some type of fastening system to hang the removable pockets on the exterior of the vest. In particular applications such as military, law enforcement, or sporting applications, there is a need to be able to position necessary pockets or other such objects where they are most useful to the individual user, as well as providing their ability to be moved to a different position as necessary for different applications.

Examples of previous types of fastening systems used to removably attach pockets to a garment include the use of hook and loop fasteners, keepers with slides, buttons, snap fasteners, and soft snap devices. Generally, the problems associated with these past methods and devices are the creation of unstable loads, unreliability, expense, or difficulty in manipulation. In addition, past systems also could be bulky and uncomfortable to the user.

A removable pocket allows the user to tailor their garment to best fit their needs, replace worn out pockets, or exchange pockets more suitable for a particular application. Another prior method for attaching a removable pocket to a garment includes the use of a flexible, yet somewhat rigid strap being attached to the pocket and threaded or interwoven between a plurality of horizontal webbings sewn onto the outer surface of the vest. A problem associated with this technique is the difficulty and time consuming nature of threading straps through a plurality of webbings to secure the pocket to the garment. Consequently, a need exists for an improved fastening system to attach removable pockets to the outer surface of a garment which is easy to install, inexpensive to manufacture and reliable for multiple applications.

SUMMARY OF THE INVENTION

The interlocking fastening system of the present invention overcomes the problems associated with previous attaching systems in an inexpensive and reliable manner. The present invention provides a molded plastic fastener which is attached to the back of a load bearing pouch or pocket. The fastener hooks to horizontal webbing loops sewn to the front of the vest or garment. Thumb pressure securely locks the fasteners to the webbing and can be removed by flexing a tab on an end of the fastener. A plurality of fasteners, also referred to herein as clips, would be positioned along the back surface of the pocket and would be threaded through the webbing loops on the vest to attach the pockets. The clips have two legs, a tab, a hook and a latch so that the latch by thumb pressure engages the hook to close and secure the latch to the webbing on the vest. The tab can be manipulated by the thumb to open the clip for removal of the pocket.

For a better understanding of the present invention, together with other features and components, reference is made to the following description taken in conjunction with the accompanying drawings.

DETAILED DESCRIPTION OF THE INVENTION

Figure 1:
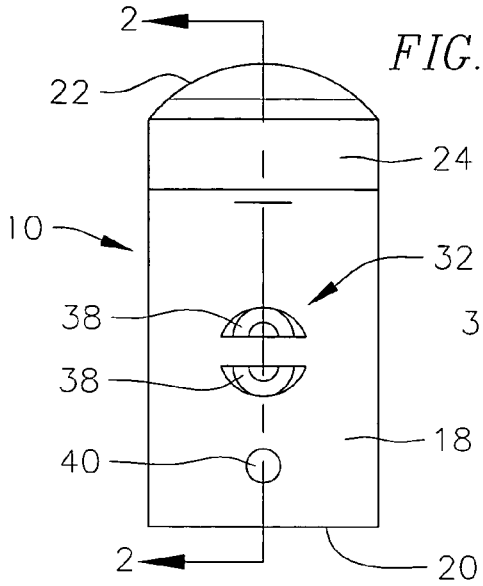
FIG. 1 is a rear view of a pocket fastener of the present invention.
Figure 2:
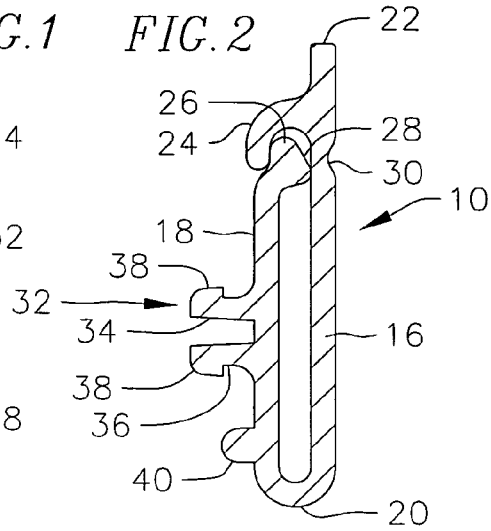
FIG. 2 is a cross sectional view of FIG. 1 taken along line 2-2.

FIGS. 1-5 illustrate the pocket fastening system of the present invention. As shown in FIGS. 1 through 4, the fastening system incorporates a fastener 10 which is secured to a backing plate 12 of a pocket 14. The fastener 10 has a front segment or section 16 and a rear segment or section 18 joined together at a curved section 20. A tab 22 is positioned at an end of the front section 16, opposite from curved section 20. A retaining hook 24 extends rearedly from front section 16 towards and downwardly to rear section 18. Rear section 18 has a latch 26 located at its end, opposite from curved section 20 which is contained under hook section 24 when the fastener is in its closed position. Latch 26 includes an angled surface 28 which rides along the hook portion 24 under pressure when the fastener is being closed. The fastener preferably is made from a molded plastic thereby allowing the fastener to be flexible. Flexibility is required to release the latch from underneath the hook section 22 when the tab is flexed outwardly. Front section 16 includes a relief 30 which assists the tab and hook section in flexing to release the latch.

Figure 3:
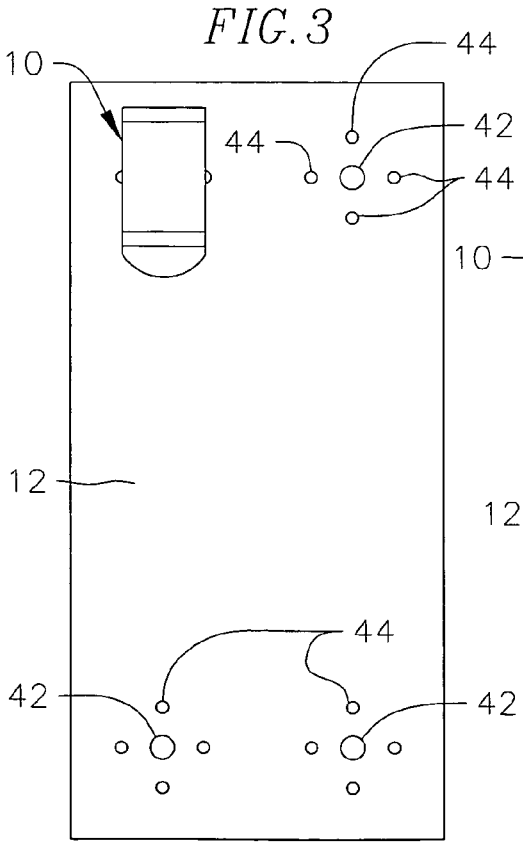
FIG. 3 is a front view of the fastener of FIG. 1 positioned on a backing plate of a pocket.
Figure 4:
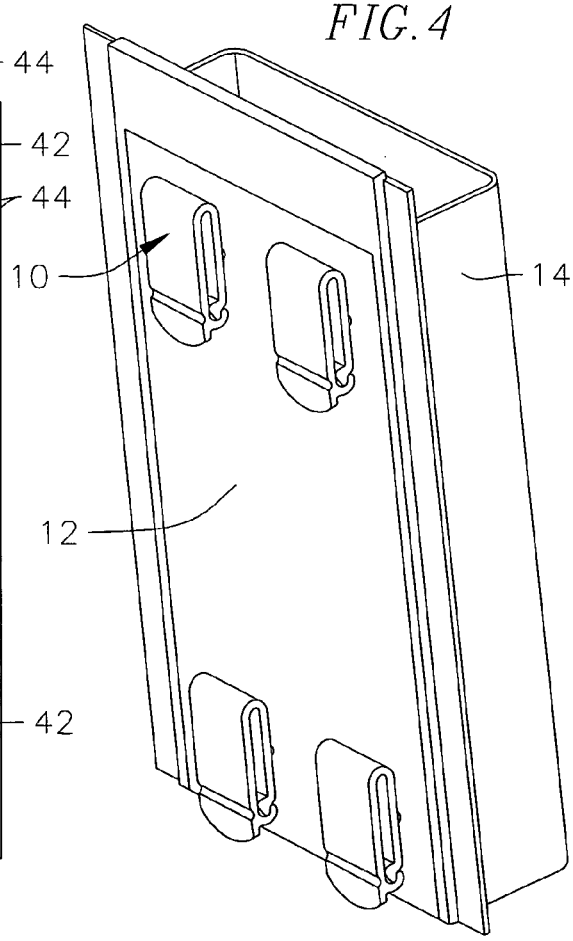
FIG. 4 is a perspective view of an assembled pocket incorporating the fasteners of FIG. 1.

Rear section 18 includes a center clip pin 32 comprising two flexible arms 34 and 36, each having a head portion 38. Rear section 18 also has a positioning pin 40 located below center clip pin 32. As seen best in FIG. 3, a plurality of fasteners are positioned to backing plate 12 by inserting center clip pin 32 through holes 42 extending through backing plate. The fastener is secured to the backing plate by the head portion 38 of the center clip pin extending through and engaging the back surface of the backing plate and arms 34 and 36 being positioned in holes 42. Positioning recesses 44 are located around holes 42 for receipt of positioning pin 40. A number of positioning recesses are located around 42 so that the fasteners can be attached to the backing plate in any desired orientation for the particular application. FIG. 3 illustrates one fastener attached to the backing plate in a vertical orientation, however, it is to be understood that a number of fasteners can be attached to a backing plate in one of many orientations as desired for the particular application. FIG. 4 illustrates four fasteners attached in a vertical orientation to the backing plate of pocket 14.

Preferably, the backing plate 12 is also plastic, however, the desired material can change depending upon a particular application. Similarly, pocket 14 can be made from canvas, nylon, or any desired material depending upon the particular application. Backing plate 12 typically would be manufactured to be a component of the pocket 14 and would be sized to fit the dimensions of the desired application.

Figure 5:
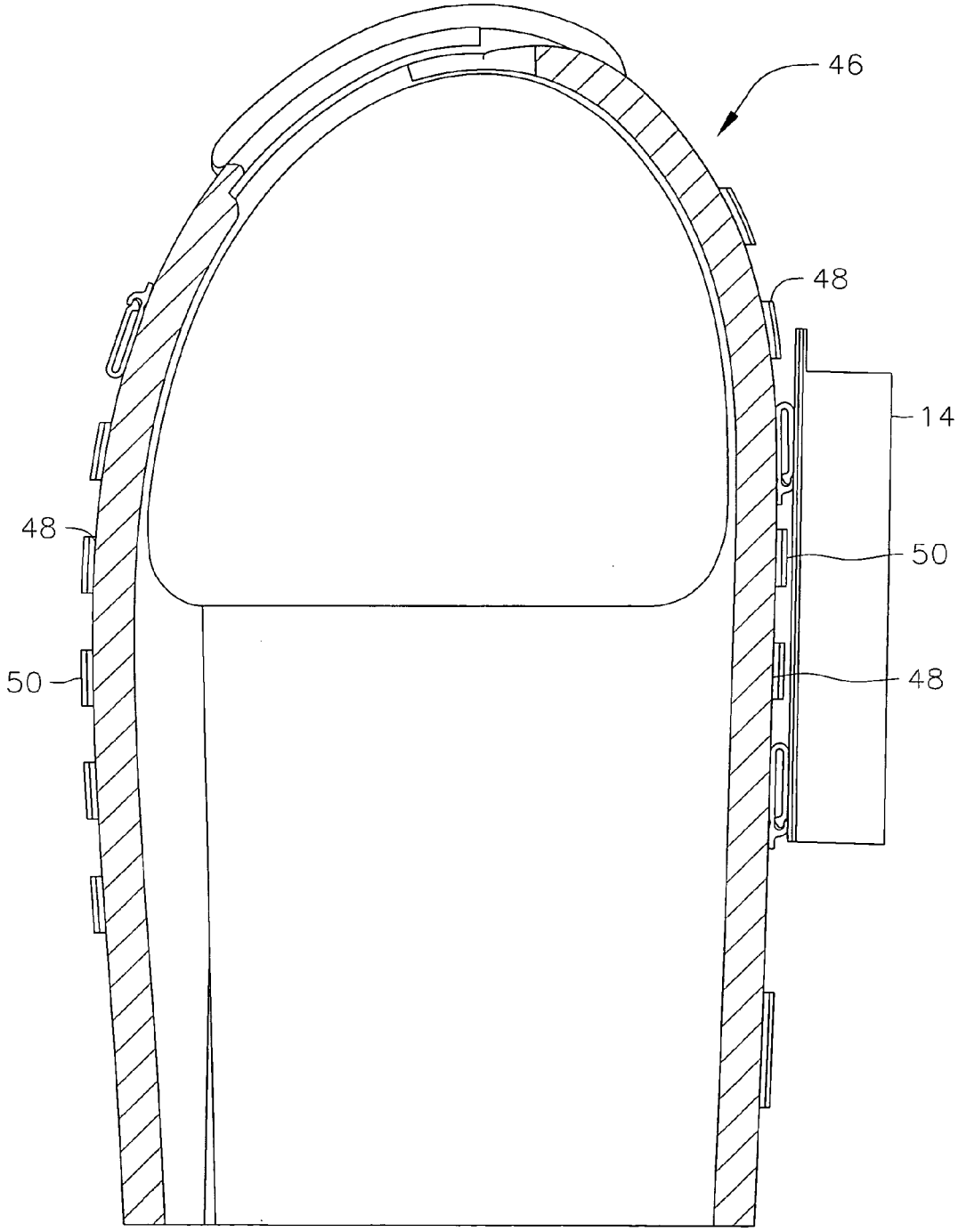
FIG. 5 is a cross sectional view of the pocket of FIG. 4 as attached to a vest.

Referring now to FIG. 5, the pocket 14 is attached to vest 46 by threading the fasteners into recesses 48 located along strips of horizontal webbing 50 positioned on a surface of the vest 46. A number of strips of horizontal webbing are positioned, usually parallel with each other, along a surface of the vest and the recesses are formed by rows of stitching sewn along the strip and spaced apart across the length of the webbing. The pocket is attached by opening the fastener and sliding the front section 16 with the tab 22 leading through the recess 48 in the webbing. Once all of the fasteners are positioned within a recess, pressure is applied to the rear section 18 so that the angled surface 28 slides along hook portion 24 and snaps underneath the hook portion to secure and close the fastener together. The pocket can be positioned horizontally, or vertically, along the surface of the vest by positioning the fasteners in the corresponding recesses in the vertical webbing. To remove, or to change locations of the pocket after it has been positioned on the vest, pressure is applied to the tab 22 thereby flexing the rear section at relief 28 to disengage the latch 26 from hook portion 24. Once all of the fasteners are open, the pocket can be lifted out of the recesses in the webbing. When the fastener is in its closed position, the webbing is fully contained between the front section 16 and the rear section 18 of the fasteners.

The invention is simple to operate by providing molded plastic fasteners, attached to the back plate of a pocket which are positioned to the horizontal webbing and applying thumb pressure to lock the webbing to the fasteners by a clicking action. The pocket can then be moved to a different location or removed from the vest by opening the fasteners by flexing the tab to disengage the front and rear sections of the fasteners. The fastening system of the present invention is an improvement over previous attachment methods by being easy to operate, quickly installed to provide a secure attachment while providing simple removal of the pocket as desired.

Although the present invention has been described and illustrated with respect to a pocket for a vest, it should be understood that the present invention is applicable for other types of containers or attachments for various garments or wearing apparel, such as shirts, jackets, pants, backpacks, or boots. In addition, although this invention has been described with reference to a particular embodiment, it is to be understood that the invention is not to be so limited and is capable of further and other embodiments within the scope of the claims appended hereto.

What is claimed is:

1. A pocket fastening system for a garment comprising:

a pocket having a backing plate and at least one garment attachment fastener having means for removably and pivotally positioning the at least one garment attachment fastener on the backing plate; and at least one horizontal webbing on the garment having at least one recess for receipt of the garment attachment fastener;

wherein the backing plate has a hole for receipt of the garment attachment fastener and a plurality of positioning recesses spaced around the hole.

2. The fastening system of claim 1 wherein the garment attachment fastener comprises:

a front section having a tab portion and a hook portion;

a back portion having a latch and a positioning pin; and an attachment pin located on the back portion.

3. The fastening system of claim 2 wherein the latch has an angled surface.

4. The fastening system of claim 2 wherein the front section has a relief adjacent the tab portion.

5. The fastening system of claim 2 wherein the attachment pin has two flexible legs, and an enlarged head portion.

6. The fastening system of claim 1 wherein the means for detachably and pivotally positioning the at least one garment attachment fastener on the backing plate is a compressible attachment pin extending from a back portion of the fastener and engaging a hole in the backing plate and a positioning pin also located on the back portion and extending into a recess in the backing plate.

* * * * *